US005238150A

United States Patent [19]

Williams, deceased

[11] Patent Number: 5,238,150

[45] Date of Patent: Aug. 24, 1993

[54] DISPENSER WITH COMPRESSIBLE PISTON ASSEMBLY FOR EXPELLING PRODUCT FROM A COLLAPSIBLE RESERVOIR

[75] Inventor: John E. Williams, deceased, late of Panorama City, Calif., by Jayne Hughes Williams, heir

[73] Assignee: William Dispenser Corporation, Los Angeles, Calif.

[21] Appl. No.: 717,661

[22] Filed: Jun. 19, 1991

Related U.S. Application Data

[63] Continuation-in-part of Ser. No. 676,314, Mar. 28, 1991, abandoned, which is a continuation-in-part of Ser. No. 649,029, Feb. 1, 1991, Pat. No. 5,186,361.

[51] Int. Cl.[5] ..... B67D 5/42

[52] U.S. Cl. ..... 222/95; 222/105; 222/340; 222/386; 222/386.5; 222/390

[58] Field of Search ..... 222/95, 105, 212, 214, 222/320, 321, 336, 337, 339-341, 386, 386.5, 387, 389, 390, 394, 401, 402.1, 325

[56] References Cited

U.S. PATENT DOCUMENTS

| | | | |
|---|---|---|---|
| 1,197,210 | 9/1916 | Jordan | 222/390 X |
| 1,476,946 | 12/1923 | Bessesen | 222/340 |
| 1,609,424 | 12/1926 | Paul | 222/389 |
| 1,664,936 | 4/1928 | Lyman | 222/340 |
| 1,717,672 | 6/1929 | Fitch | 222/340 |
| 1,762,943 | 6/1930 | Zauder | 222/390 X |
| 2,477,875 | 8/1949 | Hutchason | 222/95 |
| 2,506,833 | 5/1950 | Hunter | 222/340 |
| 2,608,320 | 8/1952 | Harrison, Jr. | 222/95 |
| 2,684,183 | 7/1954 | Werner | 222/340 X |
| 2,728,097 | 12/1955 | Seifert | 222/390 X |
| 2,738,905 | 3/1956 | Olson | 222/387 |
| 2,752,067 | 6/1956 | Kohl et al. | 222/389 |
| 3,195,168 | 7/1965 | Roberts | 401/175 X |
| 3,207,385 | 9/1965 | Featherstone et al. | 222/389 |
| 3,240,394 | 3/1966 | Modderno | 222/95 |
| 3,246,802 | 4/1966 | Fuhrmann | 222/95 |
| 3,257,036 | 6/1966 | Micallef | 222/95 |
| 3,312,378 | 4/1967 | Featherstone et al. | 222/389 |
| 3,335,913 | 8/1967 | Bouet | 222/95 |
| 3,561,644 | 2/1971 | Works | 222/95 |
| 3,613,963 | 10/1971 | Berkmuller | 222/389 |
| 3,674,179 | 7/1972 | Galloway | 222/464 X |
| 3,815,787 | 6/1974 | Spies | 222/390 X |
| 3,847,304 | 11/1974 | Cohen | 222/387 X |
| 3,871,553 | 3/1975 | Steinberg | 222/95 |
| 3,873,003 | 3/1975 | Seiferth et al. | 222/95 |
| 3,938,706 | 2/1976 | Cohen | 222/95 X |
| 3,951,310 | 4/1976 | Steiman | 222/340 X |
| 3,984,034 | 10/1976 | Cohen | 222/389 |
| 4,047,645 | 9/1977 | Caliendo | 222/386.5 |
| 4,077,544 | 3/1978 | Malacheski et al. | 222/340 X |
| 4,139,127 | 2/1979 | Gentile | 222/390 |
| 4,147,282 | 4/1979 | Levy | 222/387 |
| 4,159,790 | 7/1979 | Bailey | 222/386.5 X |
| 4,220,264 | 9/1980 | Gamadia | 222/207 |
| 4,323,177 | 4/1982 | Nielsen | 222/386 |
| 4,341,330 | 7/1982 | Mascia et al. | 222/401 |
| 4,556,156 | 12/1985 | Frutin | 222/389 X |
| 4,907,727 | 3/1990 | Ernst et al. | 222/386.5 |
| 5,042,696 | 8/1991 | Williams | 222/340 |

FOREIGN PATENT DOCUMENTS

| | | | |
|---|---|---|---|
| 1179121 | 5/1959 | France | 222/340 |
| 1288915 | 12/1962 | France | 222/95 |
| 1570600 | 6/1969 | France | 222/95 |
| 2208113 | 3/1989 | United Kingdom . | |

*Primary Examiner*—Kevin P. Shaver

*Attorney, Agent, or Firm*—Burns, Doane, Swecker & Mathis

[57] ABSTRACT

A spray dispenser comprises a container in which a product-containing bellows is situated above an energy storing bellows. A piston is disposed within the container below the energy storing bellows. A sleeve surrounds the container and is threadedly connected with the piston whereby rotation of the sleeve relative to the container causes the piston to rise and compress the energy storing bellows. The energy storing bellows thus pressurizes the product-containing bellows to expel the product when the valve is opened. The outer diameter of the bellows is of progressively reduced diameter to enable the bellows segments to become more snugly nested within one another when collapsing.

17 Claims, 3 Drawing Sheets

DISPENSER WITH COMPRESSIBLE PISTON ASSEMBLY FOR EXPELLING PRODUCT FROM A COLLAPSIBLE RESERVOIR

RELATED APPLICATIONS

This is a Continuation-in-Part of U.S. Ser. No. 07/676,314, filed Mar. 28, 1991 now abandoned which is a Continuation-in-Part of U.S. Ser. No. 07/649,029, filed Feb. 1, 1991 now U.S. Pat. No. 5,186,361.

BACKGROUND OF THE INVENTION

The present invention relates to a dispenser, especially a hand-held spray dispenser in which a spray is emitted upon manual actuation of a valve.

Hand-held spray dispensers are known in which a liquid product is contained within a flexible bag situated within a cylinder. Gas occupies a space between the bag and the cylinder. The gas, which has been pre-pressurized at the factory, functions to constantly compress the bag for expelling the contents whenever a discharge valve of the dispenser is depressed. In order to ensure that a sufficient amount of pressurized gas is available for discharging the entire liquid contents of the bag, a hydrocarbon-containing gas is usually employed. Such a gas is, however, generally realized as constituting an environmental pollutant.

Hand-held spray dispensers are also known in which a piston is housed within a container below a product to be dispensed, the product possibly being disposed within a flexible bag. By advancing the piston toward a valved end of the container, the bag is compressed to expel the product. Exemplary of such devices are the disclosures of U.S. Pat. Nos. 1,197,210; 2,728,097; 3,195,168; and 3,815,787. An advantage of a dispenser in which the product is pressurized by a mechanically-advanced piston is that no environmentally polluting gases are needed.

In the above-mentioned U.S. Pat. Nos. 1,197210 and 3,815,787, the piston carries external screw threads which mate with internal screw threads of an outer sleeve. When the outer sleeve is rotated, the piston is longitudinally advanced to collapse a bag in which the product is carried. One shortcoming of such an arrangement is that liquid or solid products carried by the bag cannot be compressed to store energy. Hence, the piston must be advanced simultaneously with actuation of the valve in order to dispense the product.

It is conventional to use a multi-piece piston having a spring disposed between the pieces in order to store energy (see above-mentioned U.S. Pat. No. 3,195,168). However, a spring-biased piston does not always impart a continuously uniform pressure to the product, whereby the spray may not be uniform.

Another shortcoming of the arrangements disclosed in U.S. Pat. Nos. 1,197,210 and 3,815,787 involves the need to prevent rotation of the piston in order to ensure that the piston will advance longitudinally in response to rotation of the outer sleeve. In U.S. Pat. No. 3,815,787, that result is achieved by the provision of a stationary thin-walled cylinder having longitudinal guide slots into which radial lugs of the piston project The thin-walled cylinder forms an inner wall of the bag-containing body, whereby there exists the possibility that the bag could become pinched between the guide slots and the piston and thus be ruptured as a consequence.

In U.S. Pat. No. 1,197,210 the piston is attached directly to the bag which means that the bag will tend to become twisted when resisting rotation of the piston unless the bag is formed of a relatively rigid material. Such material, however, will impede the collapsing of the bag, requiring that considerable force be applied to advance the piston.

SUMMARY OF THE INVENTION

The present invention relates to a dispenser, preferably a spray dispenser, which comprises an outlet valve at a longitudinal upper end of the dispenser. A product containing member is disposed beneath the valve such that an interior of the product-containing member communicates with the valve. The product-containing member includes pre-formed flex lines for facilitating a longitudinal collapsing of the product-containing member. An elastically flexible energy storing member is disposed beneath the product-containing member and contains gas. A manually actuated member is arranged to push upwardly against the energy storing member for compressing the latter and pressurizing the product-containing member. The energy storing member is expandable to expel product from the product-containing member when the valve is open, and is recompressible by the manually actuated member.

Preferably, the product-containing member and energy storing member are shaped as bellows The manually actuated member preferably comprises a piston and a rotatable sleeve in which the piston is mounted. The piston is connected to the sleeve by a connection which produces longitudinal movement of the piston in response to rotation of the sleeve.

Preferably, the dispenser includes a container which forms a compartment in which the product-containing member, the energy storing member, and the piston are disposed. The sleeve surrounds a lower portion of that container. The container includes longitudinal slots through which portions of the piston project to enable the piston to travel upwardly within the compartment.

Preferably, the product-containing bellows includes a plurality of inner connected frusto-conical segments which are arranged to be longitudinally collapsed. The segments have outer diameters which are of progressively reduced dimension in one longitudinal direction.

The product-containing bellows includes a bottom facing surface which preferably contains a semi-spherical depression. A top wall of the energy storing member contains a semi-spherical projection which is received in the depression.

The present invention also pertains to a refill unit, and to the configuration of the product-containing bellows wherein the outer diameters of the segments thereof are of progressively reduced dimension.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
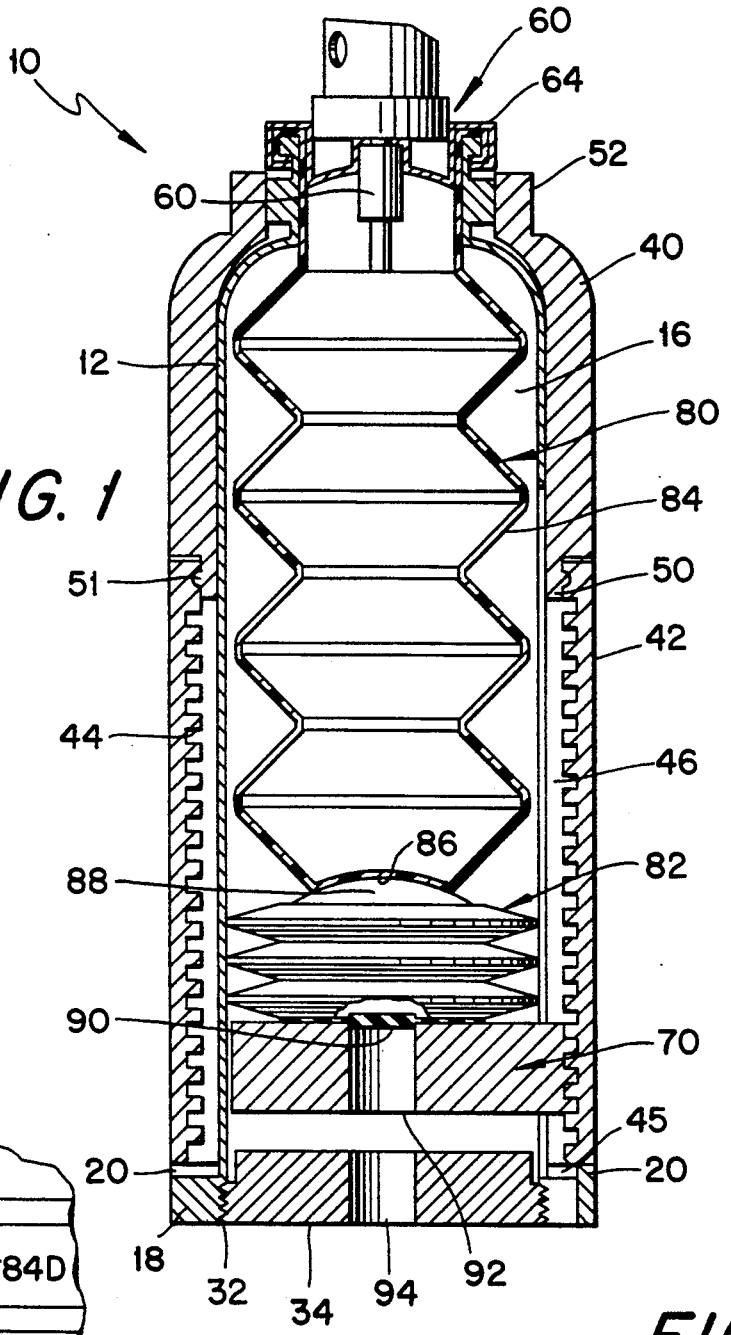
FIG. 1 is a longitudinal sectional view through a dispenser according to the present invention.
Figure 4:
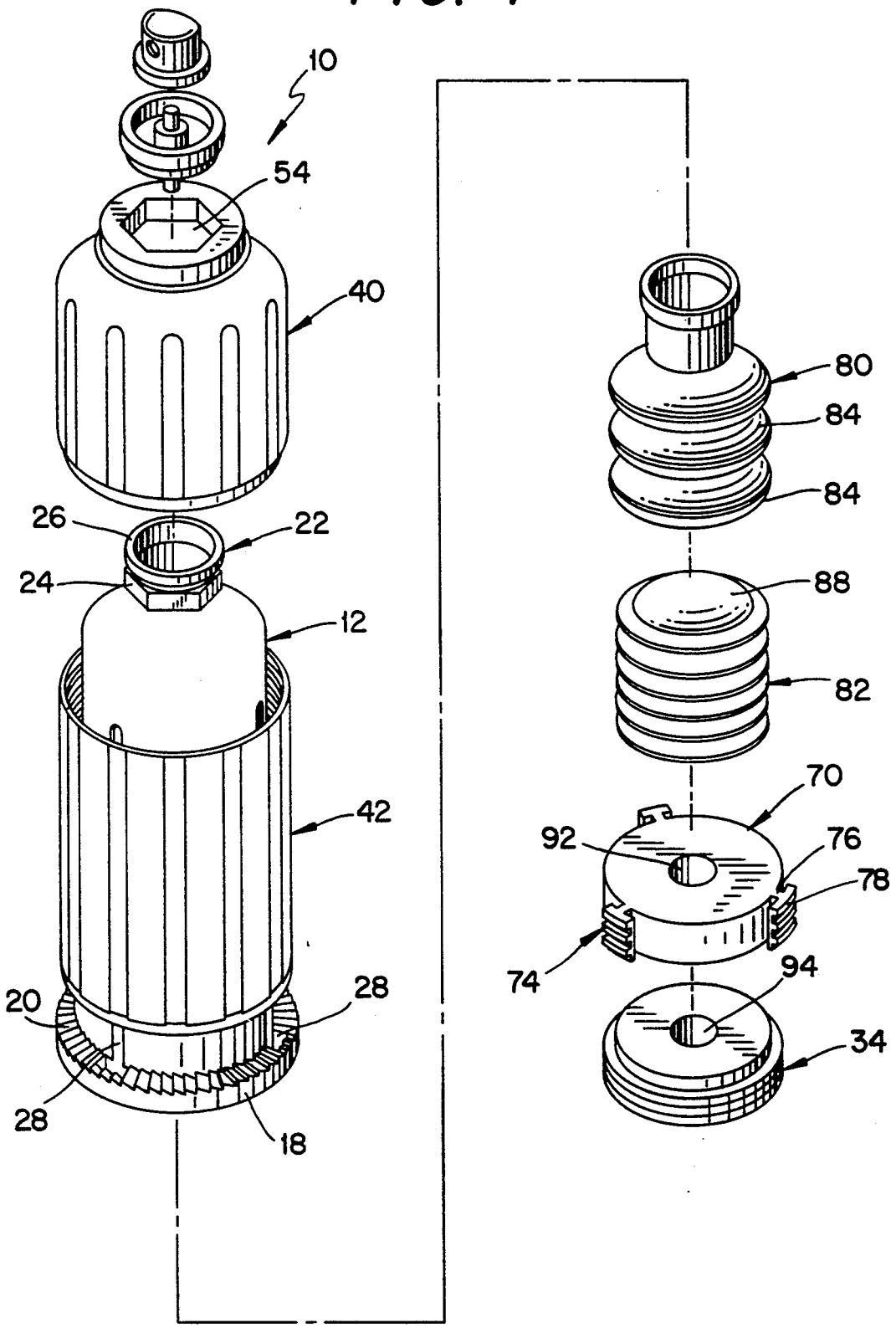
FIG. 4 is an exploded perspective view of the dispenser.
Figure 5:
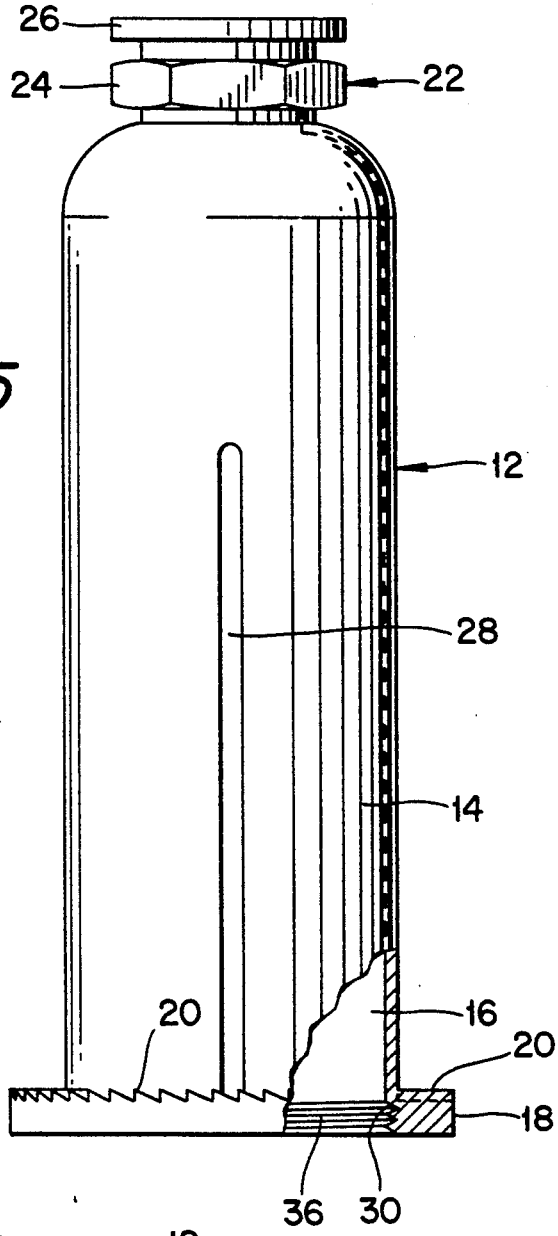
FIG. 5 is a side elevational view, partially broken away, of a container member of the dispenser.

As depicted in FIGS. 1 and 4, a spray dispenser 10 comprises a container 12 having a generally cylindrical portion 14 which forms an inner compartment 16. A lower end of the cylindrical portion is of enlarged diameter to form an annular base 18, an upper surface of which carries a set of ratchet teeth 20 (see FIGS. 4 and 5). An upper end of the cylindrical portion 14 narrows to form a neck 22. The neck includes a hexagonally-shaped head 24 and an annular, radially outwardly projecting rim 26. The container is open at its upper and lower ends.

Figure 6:
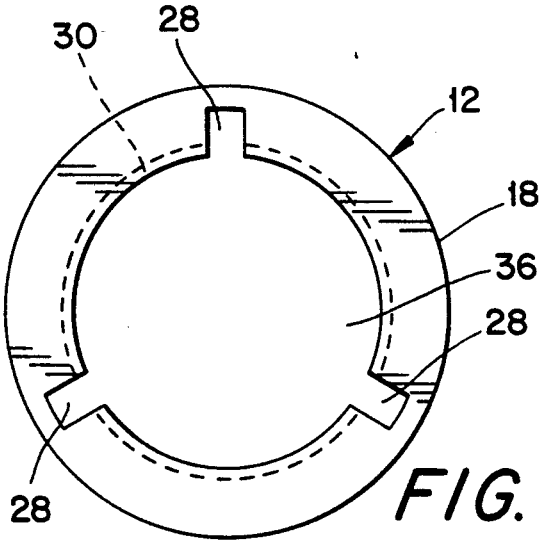
FIG. 6 is a bottom view of the container depicted in FIG. 5.

Projecting upwardly through the wall of the container are three longitudinal slots 28 which are spaced equidistantly around the circumference of the container, i.e., the slots are spaced apart by 120° (see FIG. 6). Each slot extends completely radially through the wall of the cylindrical portion, but only partially radially through the base portion 18 (see FIG. 4). Each slot extends longitudinally completely through the base portion, whereas an upper end of each slot is spaced a distance below the neck 22.

A bottom hole 36 of the base portion 18 includes an internal thread 30 which mates with a corresponding external thread 32 of a bottom closure 34 (see FIGS. 1 and 4).

Mounted telescopingly over the outer periphery of the container 12 is an outer sleeve which comprises upper and lower portions 40, 42. The sleeve lower portion 42 is of generally cylindrical shape and includes a helical thread 44 formed in its inside surface. A downwardly facing surface of the sleeve lower portion 42 includes ratchet teeth 45 which engage the teeth 20 of the container 12. Each of the teeth 45, 20 is of the type formed by the intersection of a longitudinal tooth face and an inclined tooth face. Hence, when the sleeve lower portion 42 is rotated in a direction causing the longitudinal faces of abutting teeth 20, 45 to abut (i.e., in a direction from left to right in FIG. 5), the sleeve lower portion 42 cannot be rotated relative to the container 12. If the sleeve lower portion 42 is rotated in the opposite direction, however, such relative rotation is permitted, as the teeth 45 will slide over the teeth 20.

The diameter of the inside surface of the sleeve lower portion 42 is somewhat larger than the outer diameter of the cylindrical portion 14 of the container 12 to form an annular gap 46 therebetween. That gap 46 accommodates the reception of a downwardly projecting annular skirt 50 of the sleeve upper portion 40 when the latter has been fitted onto the upper end of the container 12. The skirt 50 carries an annular bead 51 which snaps into a corresponding groove of the sleeve lower portion 42 to removably secure the sleeve portions 40, 42 together, while permitting the sleeve lower portion 42 to rotate relative to the sleeve upper portion 40.

The sleeve upper portion 40 narrows to a neck 52 at its upper end, the neck defining a hexagonal inner aperture 54 which receives the correspondingly shaped head 24 of the container 12 to prevent relative rotation between the container 12 and the sleeve upper portion. The sleeve outer peripheries of the portions 40, 42 can be knurled or corrugated to facilitate gripping thereof.

A conventional valve 60 and valve actuator 62 are mounted in a conventional way to the upper end of the container, e.g., by crimping a flange 62 of the valve 60 around the rim 26 of the container.

Figure 7:
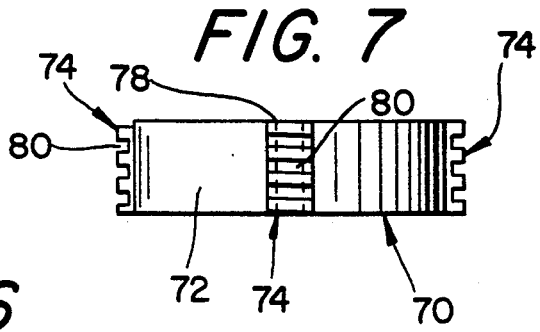
FIG. 7 is a side elevational view of a piston member according to the present invention.

Slidably mounted within the container is a piston 70 (see FIGS. 1 and 7). As will be explained, rotation of the sleeve outer portion 42 relative to the container 12 causes the piston to travel longitudinally upwardly within the container 12.

The piston 70 comprises a cylindrical disc 72 having a plurality of radially projecting lugs 74. The number and mutual spacing of the lugs 74 corresponds to the number of slots 28 in the cylinder (in this case, three lugs). Each lug includes a tongue 76 and a head 78. The tongue has a dimension in the circumferential direction of the disc which is slightly smaller than the corresponding dimension of each slot 28, whereby the tongues are able to slide longitudinally within respective slots. The head 78 is of larger longitudinal dimension than the tongue and contains grooves 80 in its radially outwardly directed face. The grooves of the lugs are cooperatively configured to define segments of a helical screw thread which mates with the inner helical screw thread 44 of the sleeve lower portion 42.

The piston 70 can be inserted upwardly into the container through the bottom hole 36 thereof an then mated with the screw thread 44 of the sleeve outer portion 42 in response to relative rotation between the container 12 and the sleeve outer portion 42. The closure 34 can then be threaded into the hole 36 of the container to prevent dislodgement of the piston.

Since the piston 70 cannot rotate relative to the container 12 (by virtue of the presence of the lugs 74 within the slots 28), rotation of the sleeve lower portion 42 relative to the container 12 will cause the piston to travel longitudinally within the container. As noted earlier, such relative rotation is permitted in only one direction by the ratchet teeth 20, 45. The threaded connection between the piston and sleeve lower portion 42 is configured to ensure that the piston will move longitudinally upwardly within the container in response to such relative rotation.

Disposed within the container compartment 16 between the valve 60 and the piston 70 are a collapsible product-containing member 80 and an energy storing member 82. The product-containing member 80 is of bellows shape in that it comprises a plurality of frusto-conical segments 84, each of which is flexibly joined to one or two of the other segments 84 at its large and small diameter ends.

During use of the dispenser, the product-containing member is caused to collapse longitudinally in response to upward travel of the piston 70 and energy storing member 82.

Figure 2:
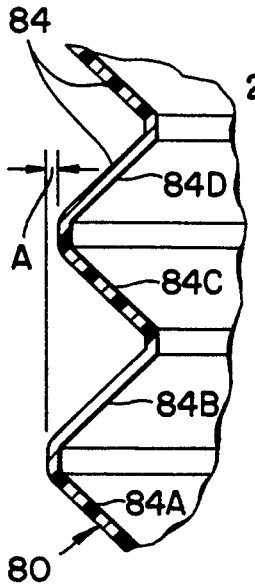
FIG. 2 is an enlarged fragmentary longitudinal sectional view taken through a product-containing bellows according to the present invention.
Figure 3:
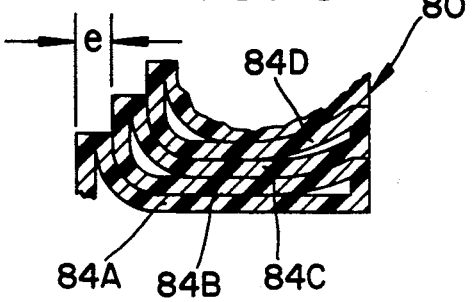
FIG. 3 is a view similar to FIG. 2 showing the manner in which the frusto-conical segments of the bellows become longitudinally collapsed.

The bellows is shaped such that the maximum outer diameters of the frusto-conical segments 84 become progressively larger in the downward direction. That is apparent from FIG. 2 which shows a radial gap A between two vertically successive outer diameters of the bellows. That gap A is sized in accordance with the thickness of the bellows wall to permit a more thorough collapsing of the bellows segments when the piston is raised. The manner of collapsing is depicted in FIG. 3, wherein the bellows segments 84A–84D become nested within one another as the bellows 80 collapses. As a result, less of the product will remain once the product bellows 80 has been fully collapsed. By way of example, the outer diameters of the bellows segments could be progressively reduced by about 0.050".

The top end of the product-containing member 80 is attached to the upper end of the container 12 such as by being crimped therearound. The bottom facing surface 86 of the product containing member 80 is of concave-convex shape (see FIG. 1), preferably semi-spherical in shape, for receiving a correspondingly shaped top wall 88 of the energy storing member 82. The latter is also of bellows shape so as to be elastically longitudinally compressible. The bellows 82 contains a compressible gas, such as nitrogen or air for example, and is sealed, whereby the extent by which bellows 82 can be collapsed is a function of the compressibility of the gas. Collapsing of the bellows 82 occurs when the piston 70 is raised, as the bellows 82 will be compressed between the product-containing bellows 80 and the piston 70. Thus, the rising motion of the piston 70 will cause both bellows 80, 82 to be compressed, thereby storing energy (compressed gas) in the lower bellows 82. As the lower bellows attempts to expand, it pressurizes the product within the upper bellows 80.

When the valve 60 is opened, the pressurized product will be expelled, until the energy-storing bellows 82 becomes fully expanded so as to deplete its stored energy. This may occur as the result of a prolonged valve-opening duration, or numerous short valve-opening durations.

Centrally located in a bottom wall of the lower bellows 82 is an elastic grommet 90 (preferably rubber) which is aligned with central apertures 92, 94 in the piston and bottom closure member 34, respectively. Gas can be introduced into the lower bellows 82 (in order to charge that bellows) subsequent to assembly of the dispenser by means of a needle which is inserted through the apertures 92, 94 and the grommet 90. When the needle is withdrawn, the grommet will self-seal.

The dispenser can be used as a refillable dispenser by sliding the sleeve upper portion 42 off the container 12, and then unscrewing the sleeve lower portion 42 from the container. Those sleeve portions 40, 42 can then be attached to a refill unit comprised of the container 12, product bellows 80, energy storing bellows 82, piston 70, and closure 34. As used herein the term "dispenser" also refers to such refill unit with or without the sleeve 40, 42.

Alternatively, the entire dispenser could be thrown away after use. In that case, the sleeve portions would be formed of thinner and less costly material, and in fact, the sleeve upper portion 40 could be eliminated, with the upper end of the sleeve lower portion 42 being configured to engage the container to close-off the gap 46. A user would grasp the upper portion of the container 12 during use.

In use, the consumer purchases the dispenser as depicted in FIG. 1. The energy-storing bellows 82 would be filled with gas and would be in either a compressed or non-compressed state. If the bellows 82 is non-compressed, then the consumer would grasp the sleeve upper portion 40 with one hand and rotate the sleeve lower portion 42 with the other hand. The rotation would occur in the single direction permitted by the one-way ratchet teeth 20, 46 interconnecting the container 12 with the sleeve lower portion 42. In response to such rotation, the threaded connection 44, 74 between the sleeve lower portion 42 and the piston 70 causes the piston to rise within the container, whereupon the energy-storing bellows 82 is collapsed in order to compress the gas therein. Once compressed, the gas attempts to expand, thereby pressurizing the product within the upper bellows 84. Thus, whenever the consumer opens the valve 60, the product will be expelled, preferably as a spray. The product will be expelled until the lower bellows 82 has fully expanded, thereby depleting its stored energy. In order to re-energize the lower bellows 82, the sleeve lower portion 42 is again rotated.

As this procedure is periodically repeated, the upper bellows 80 will be gradually collapsed. Due to the configuration of that bellows 80, wherein the outer diameter thereof progressively increases in one direction (preferably in the downward direction), the bellows 80 will be able to be more completely compressed and thus able to expel a higher percentage of the product.

It will be appreciated that the present invention enables a product to be dispensed, preferably by spraying, without the need for polluting-types of propellants. The use of compressed gas as a propelling force gives rise to a generally uniform transmission of forces across the interface between the bellows. The uniformity of that pressure further results from the hemispherical shape of that interface. Since the propelling gas is confined within a bellows, there is no risk that the gas will migrate through the wall of the container. Hence, virtually any suitable type of plastic (or metal) material can be used to construct the container, as well as the other components of the dispenser. The upper bellows 40 may preferably be formed of polyethylene or polypropylene for example, whereas the lower bellows 42 and container 12 could be formed of PET. The remaining components can be formed of metal or a suitable plastic material, although the crimpable part of the valve 60 should preferably be formed of metal.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A dispenser comprising an outlet valve at a longitudinal upper end of the dispenser; a product-containing member disposed beneath said valve such that an interior of said product-containing member communicates with said valve; said product-containing member including pre-formed flex lines for facilitating a longitudinal collapsing of said product-containing member; an elastically flexible energy-storing member disposed beneath said product-containing member and containing gas; and a manually actuated member arranged to push upwardly against said energy-storing member for compressing said energy-storing member and pressurizing said product-containing member; said energy storing member being expandable to expel product from said product-containing member when said valve is open, and being recompressible by said manually actuated member, a bottom facing surface of said product-containing bellows containing a semi-spherical depression; a top wall of said energy-storing member containing a semi-spherical projection received in said depression.

2. A dispenser according to claim 1, wherein said product-containing member comprises a bellows.

3. A dispenser according to claim 1, wherein said energy-storing member comprises a bellows.

4. A dispenser according to claim 1, wherein said manually actuated means comprises a piston.

5. A dispenser according to claim 4, wherein said manually actuated means further comprises a rotatable sleeve in which said piston is mounted; said piston being connected to said sleeve by connecting means producing longitudinal movement of said piston in response to rotation of said sleeve.

6. A dispenser according to claim 5 including a container forming a compartment in which said product-containing member, said energy-storing member, and said piston are disposed, said sleeve surrounding a lower portion of said container, said container including longitudinal slots through which said connecting means projects to enable said piston to travel upwardly within said compartment.

7. A dispenser according to claim 6, wherein said valve is connected to said container, said sleeve being removable from said connecting means and from said container to enable said sleeve to be reconnected to a replacement container.

8. A dispenser according to claim 6, wherein said container and sleeve are interconnected by ratchet teeth permitting rotation of said sleeve relative to said container in only one direction.

9. A dispenser according to claim 1 including a container defining a compartment in which said product-containing member is disposed; said product-containing member comprising a bellows, said bellows including a plurality of interconnected frusto-conical segments arranged to be longitudinally collapsed, said segments having outer diameters which are of progressively reduced dimension.

10. A dispenser according to claim 9, wherein said outer diameters are of progressively reduced dimension in an upward direction of said bellows.

11. A dispenser comprising:

a casing including a rotatable sleeve having an internal screw thread;

a container disposed in said sleeve and forming an internal compartment, said container including a cylindrical portion having longitudinal slots therein;

a piston mounted in said compartment and including radially outwardly projecting lugs extending radially through respective ones of said slots, each of said lugs including external screw means coupled to said internal screw thread;

said sleeve being rotatable relative to said container and said piston to cause said piston to move longitudinally upwardly within said compartment;

a longitudinally collapsible product-containing bellows disposed in said compartment above said piston and communicating with an outlet valve of said dispenser;

an elastically flexible energy storing member disposed in said compartment between said product-containing bellows and said piston, said energy-storing member containing gas and being compressible in response to upward movement of said piston, whereby said product-containing bellows is pressurized; said energy-storing member being expandable to expel product from said product-containing bellows when said valve is open and being recompressible by said piston, a bottom wall of said product-containing bellows containing a spherical depression; an upper wall of said energy-storing member containing a spherical projection received in said spherical depression.

12. A dispenser comprising:

a casing including a rotatable sleeve having an internal screw thread;

a container disposed in said sleeve and forming an internal compartment, said container including a cylindrical portion having longitudinal slots therein;

a piston mounted in said compartment and including radially outwardly projecting lugs extending radially through respective ones of said slots, each of said lugs including external screw means coupled to said internal screw thread;

said sleeve being rotatable relative to said container and said piston to cause said piston to move longitudinally upwardly within said compartment;

a longitudinally collapsible product-containing bellows disposed in said compartment above said piston and communicating with an outlet valve of said dispenser; an elastically flexible energy storing member disposed in said compartment between said product-containing bellows and said piston, said energy-storing member containing gas and being compressible in response to upward movement of said piston, whereby said product-containing bellows is pressurized; said energy-storing member being expandable to expel product from said product-containing bellows when said valve is open and being recompressible by said piston, said casing including an additional sleeve disposed above said rotatable sleeve; said additional sleeve being non-rotatable relative to said container, a bottom wall of said product-containing bellows containing a spherical depression; an upper wall of said energy-storing member containing a spherical projection received in said spherical depression.

13. A dispenser according to claim 12, wherein said bellows includes a plurality of interconnected frusto-conical segments having outer diameters which are of progressively reduced dimension.

14. A dispenser according to claim 12 including means permitting rotation of said sleeve relative to said container in only one direction.

15. A dispenser according to claim 14, wherein said last-named means comprises interengaging ratchet teeth on said container and sleeve.

16. A dispenser according to claim 12, wherein said valve is mounted on said container, whereby said sleeve is removable from an empty unit comprised of said valve, said container, said product-containing bellows, said energy-storing member, and said piston for re-use with a full unit.

17. A dispenser according to claim 12, wherein said energy-storing member comprises a bellows.

* * * * *